US006553927B1

(12) United States Patent
Kawai

(10) Patent No.: US 6,553,927 B1
(45) Date of Patent: Apr. 29, 2003

(54) SPREADER DRIVING DEVICE OF A SEWING MACHINE

(75) Inventor: Hironao Kawai, Higashi-Osaka (JP)

(73) Assignee: Hosei Mishin Seizo Kabushiki Kaisha, Osaka (JP)

( * ) Notice: Subject to any disclaimer, the term of this patent is extended or adjusted under 35 U.S.C. 154(b) by 0 days.

(21) Appl. No.: 10/013,649

(22) Filed: Dec. 13, 2001

(30) Foreign Application Priority Data

Oct. 29, 2001 (JP) ..... 2001-330485

(51) Int. Cl.[7] ..... D05B 69/12
(52) U.S. Cl. ..... 112/220
(58) Field of Search ..... 112/220, 187, 112/166, 475.16, 475.17

(56) References Cited

U.S. PATENT DOCUMENTS

| | | | | |
|---|---|---|---|---|
| 2,874,661 A | * | 2/1959 | Parry et al. | 112/178 |
| 5,383,414 A | * | 1/1995 | Winter et al. | 112/100 |
| 5,517,933 A | * | 5/1996 | Karaba, Jr. | 112/166 |
| 5,901,655 A | * | 5/1999 | Sadasue | 112/162 |

FOREIGN PATENT DOCUMENTS

| | | |
|---|---|---|
| JP | 58-138476 | 8/1993 |
| JP | 10-137474 | 5/1998 |
| JP | 2002-974 | 1/2002 |

* cited by examiner

*Primary Examiner*—Ismael Izaguirre
(74) *Attorney, Agent, or Firm*—Wenderoth, Lind & Ponack, L.L.P.

(57) ABSTRACT

A spreader driving device is constructed so that the stepping motor (2) driven in synchronism with the elevating motion of a needle bar and the support shaft (3) are provided at a frame mounted to the back side of a presser foot. A lever (4), fitted onto the support shaft, is provided at the rear end with a sector gear (6) and at the fore end with a spreader (5). The sector gear engages with a driving gear (7) driven by an output shaft (8) of the stepping motor, so as to swing the lever (4) and spreader (5) by the drive of stepping motor. Also, the frame is divided into a movable frame having the stepping motor, the support shaft, and the lever mounted thereon, and a fixed frame (17) for mounting the device to the sewing machine. Between the frames is arranged a shifting device (18) for shifting the movable frame a moderate distance parallel to the needle position with respect to the fixed frame, whereby the center of swinging motion of the spreader can be shifted from a point P1 to a point P2.

5 Claims, 6 Drawing Sheets

SPREADER DRIVING DEVICE OF A SEWING MACHINE

BACKGROUND OF THE INVENTION

The present invention relates to a spreader driving device for a sewing machine, including a stepping motor which starts in synchronism with the elevating motion of a needle bar. The stepping motor drives a lever provided with a spreader used to perform, for example, the upper decorative stitch operation or the smock stitch operation. The spreader driven by the stepping motor can be shifted at the center of swinging motion thereof toward a suitable position corresponding to the selected stitch operation.

The present invention has been filed as Japanese Patent Application No. 2000-189417 and No. 2001-17137 with the Japanese Patent Office as an upper decorative stitching device to drive the spreader to perform an upper decorative stitch operation or a smock stitch operation by use of the stepping motor. The upper decorative stitching device is disclosed in Japanese Patent Laid-Open Gazette No. Hei 10-137474, which is a prior application by the present applicant. Also, the upper decorative stitching device provided with two spreaders has been disclosed in, for example, Japanese Patent Laid-Open Gazette No. Sho 58-138476.

The usual upper decorative stitching devices including the above-mentioned devices are divided into those of smock stitch operation and upper decorative stitch operation, which are almost constructed so as to use the predetermined stitch operation only.

The problem that the present invention is to solve is that firstly, a lever provided at the tip thereof with the spreader is driven by the stepping motor starting in synchronism with the elevating motion of a needle bar.

Secondly, the lever acting as the center of swinging motion of the spreader generates the least skip stitches corresponding to the selected stitch operation respectively and can be shifted to the most suitable position for avoiding interference with the needle and spreader.

SUMMARY OF THE INVENTION

In order to solve the above-mentioned first problem, the present invention provides a spreader driving device for a sewing machine, which is so constructed that a frame mounted to the back side of a presser foot for the sewing machine is provided with the stepping motor and the support shaft. A lever provided at the rear end thereof with a sector gear and at the fore end with the spreader is swingably fitted onto the support shaft. The sector gear of the lever engages a gear driven by an output shaft of the stepping motor, and the stepping motor operates in reciprocation with the elevating motion of a needle bar so as to swing the lever. Therefore, the spreader provided at the fore end of the lever is driven in reciprocation along the upper surface of a presser foot.

In order to solve the second problem, the present invention provides a spreader driving device which divides the frame into a movable frame provided with the stepping motor, the support shaft and the lever, and a fixed frame for mounting the device to the sewing machine. Between both the frames is arranged a shifting means for shifting the movable frame a moderate distance parallel to the needle position with respect to the fixed frame fixed at the sewing machine side for holding the fixed frame at the shifting destination. Therefore, the center of swinging motion of the spreader can be displaced corresponding to a selected stitch operation.

As mentioned above, the spreader driving device according to the present invention is made to drive the lever having the spreader at the fore end thereof by the stepping motor in synchronism with the elevating motion of a needle bar. Thus, an accurate stitch operation can be performed without generating skip stitch, and can avoid interference with the needle and spreader.

Also, the movable frame movably provided corresponding to the selected stitch operation can be shifted together with the stepping motor, the support shaft, and the lever, so that the support shaft serving as the center of swinging motion of the spreader can be shifted to the most suitable position to the stitch operation. Thus, it is further possible to perform the stitch operation without generation of skip stitch and to avoid the interference with the needle and spreader.

The device of the present invention can be constructed so that the levers provided with the sector gears respectively are fitted at two vertical stages onto the support shaft. The sector gear of one lever engages with a driving gear mounted on the output shaft of the stepping motor, the sector gear of the other lever engages with a driven gear engageable with the above-mentioned driving gear so as to mutually reversely rotate, and the stepping motor operates to drive the levers in two vertical stages to move in reciprocation in opposite directions to each other. The spreaders for the upper decorative stitch operation and smock stitch operation are exchangeably mounted onto the tips of the respective levers. The shifting means is operated to displace the support shaft in position rightwardly against the sewing machine during the upper decorative stitch operation so as to swing the upper decorative stitching spreader, and the support shaft is displaced onto the center line of needle position during the smock stitch operation so as to swing the smock stitch spreader. Thus, the center of swinging motion of the spreader is put at the most suitable position for the respective selected stitch operations.

The shifting means can comprise fixed pins which are disposed at a plurality of positions on the movable frame, and a plurality of slots are provided at the fixed frame so as to fit the respective fixed pins parallel to the needle position of the sewing machine. Presser plates bring the movable frame into close contact with the rear surface of the fixed frame and in slidably press contact with the fixed frame. A switching lever is swingably provided on the fulcrum shaft erected on the fixed frame, and fits into a slot formed at the middle portion of the lever a support pin erected on the movable frame. A toggle spring is stretched between the tip of the switching lever and one end of the movable frame so as to hold the movable frame in the upper decorative stitching position and smock stitching position. The shifting operation of the center of swinging motion of the spreader and the holding of the position in the shifting destination are easy to perform by a relatively simple construction.

A rod of proper length can be fixed at the base of one lever on the support shaft, a counter bar can be detachably connected to the tip of the rod, and a slide guide part can be provided at the movable frame along the cloth feed direction. The counter bar is slidably fitted into the slide guide part, and a thread guide for the upper decorative stitch operation is mounted onto the tip of the lever and synchronized with the swinging motion of the other lever to be longitudinally slid at the lateral side of needle position, whereby the thread feed to the spreader can be smoothed and the interference with the needle and spreader can be avoided as much as possible.

DETAILED DESCRIPTION OF THE INVENTION

Next, an explanation will be given of embodiments of the present invention in accordance with the accompanying drawings.

Figure 1:
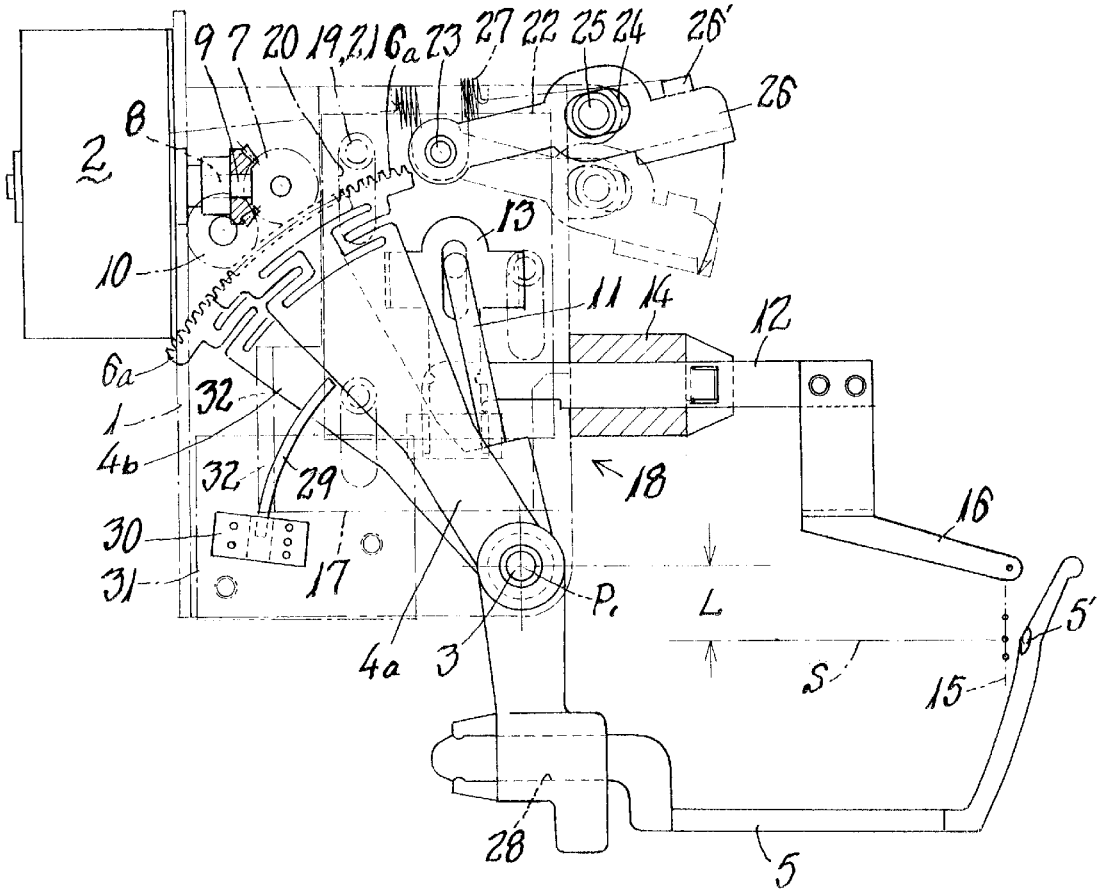
FIG. 1 is a partial cutaway plan view showing the state of use during the upper decorative stitch operation and the principal portion of the driving process in the embodiment.
Figure 2:
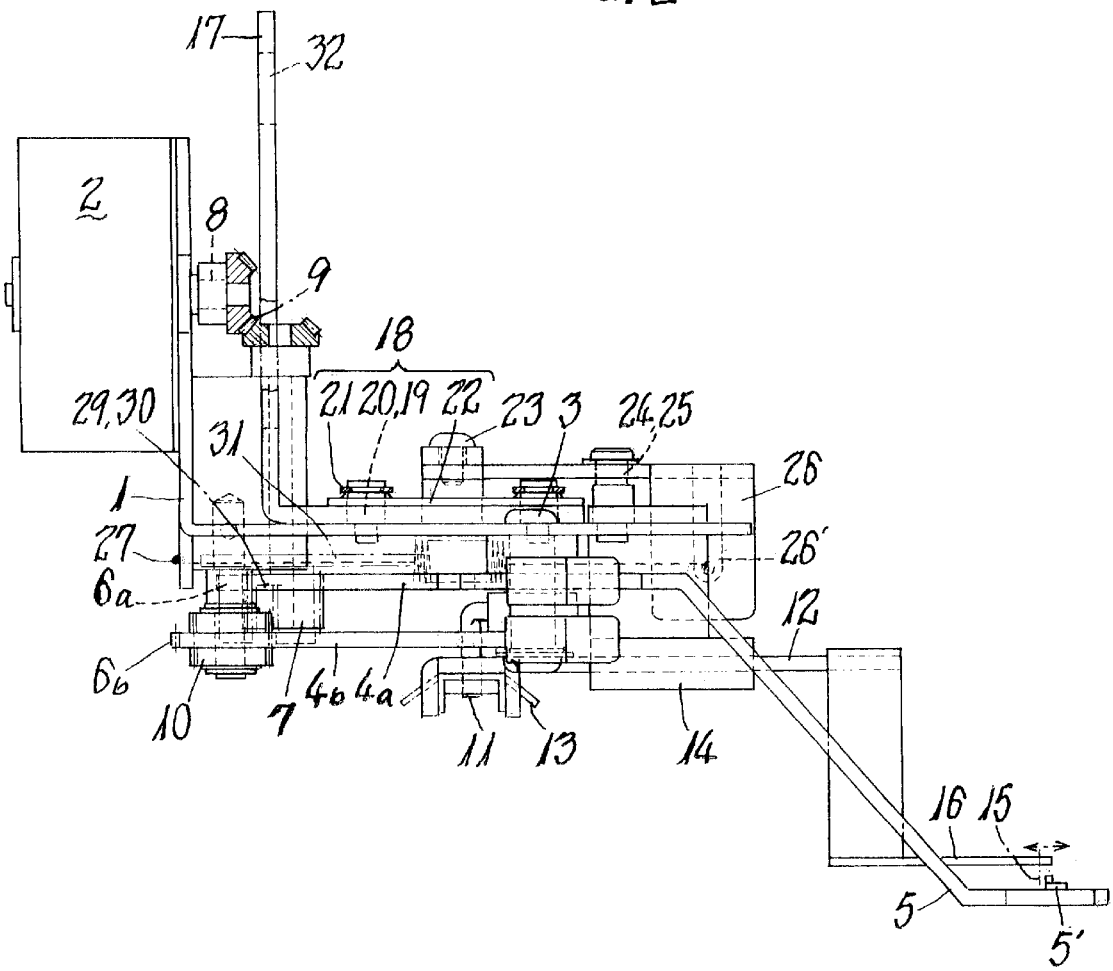
FIG. 2 is a side view of the same state shown in FIG. 1.
Figure 3:
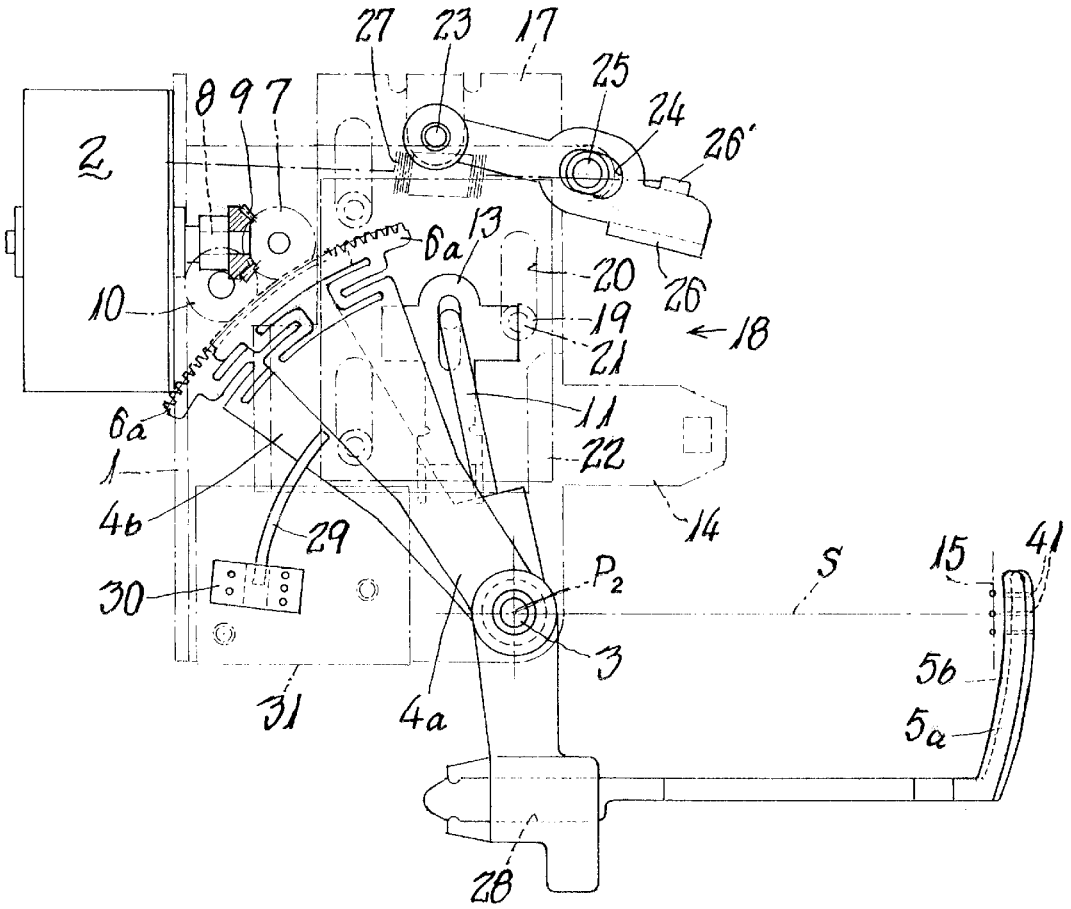
FIG. 3 is a partial cutaway plan view showing the state of use when the embodiment is switched to the smock stitch operation.
Figure 4:
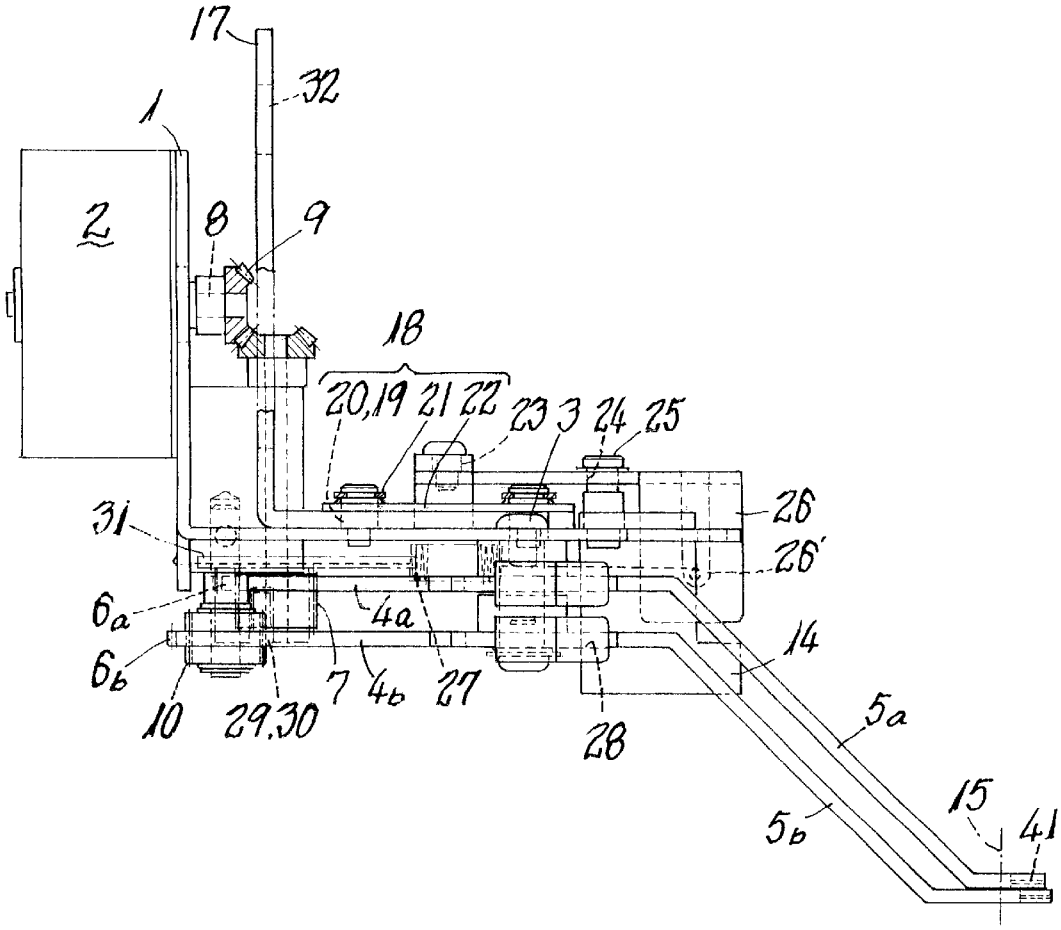
FIG. 4 is a side view of the same state shown in FIG. 3.
Figure 5:
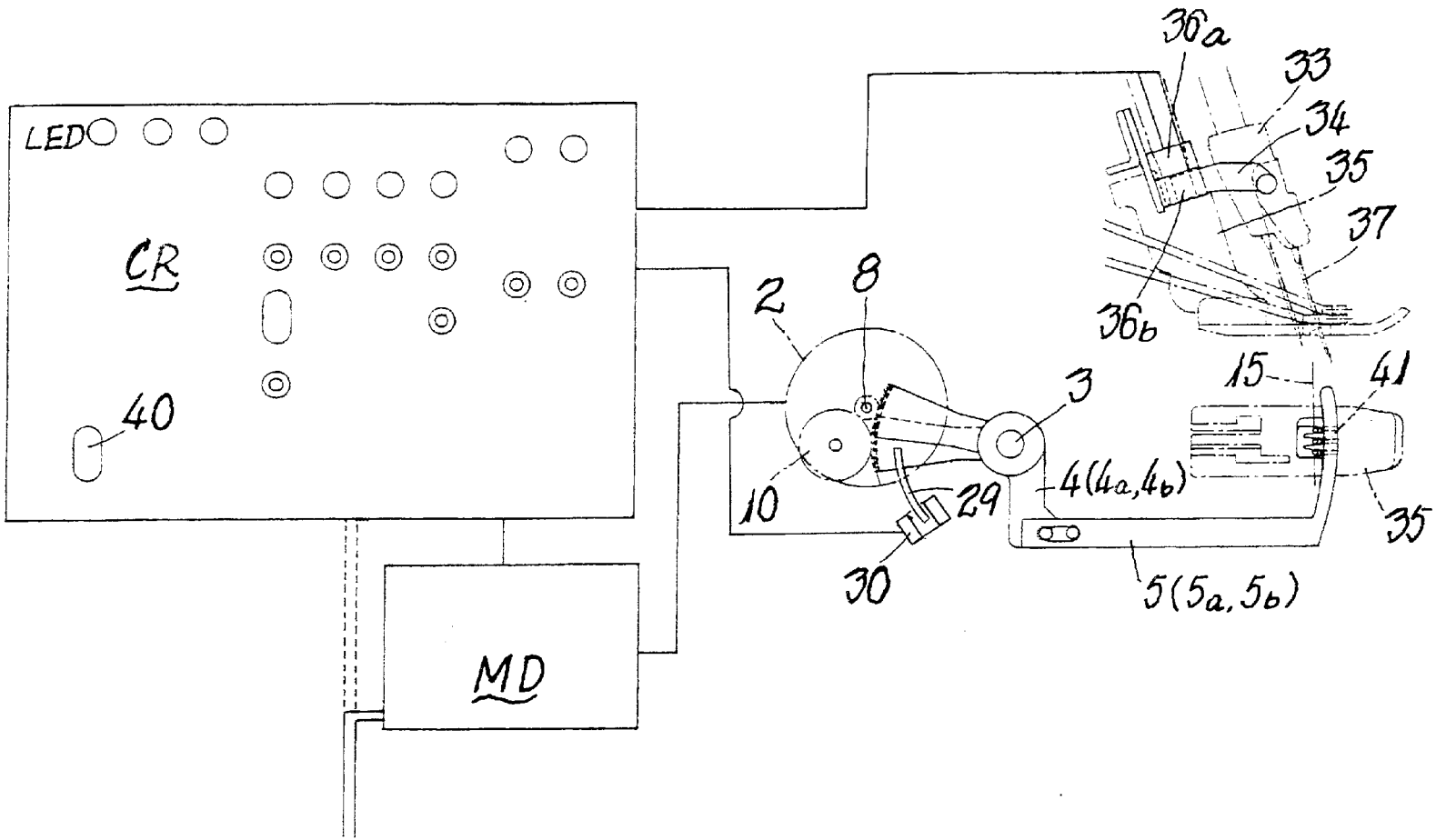
FIG. 5 is a schematic view showing the construction for synchronizing the elevating vertical motion of a needle bar with the operation of the stepping motor.
Figure 6:
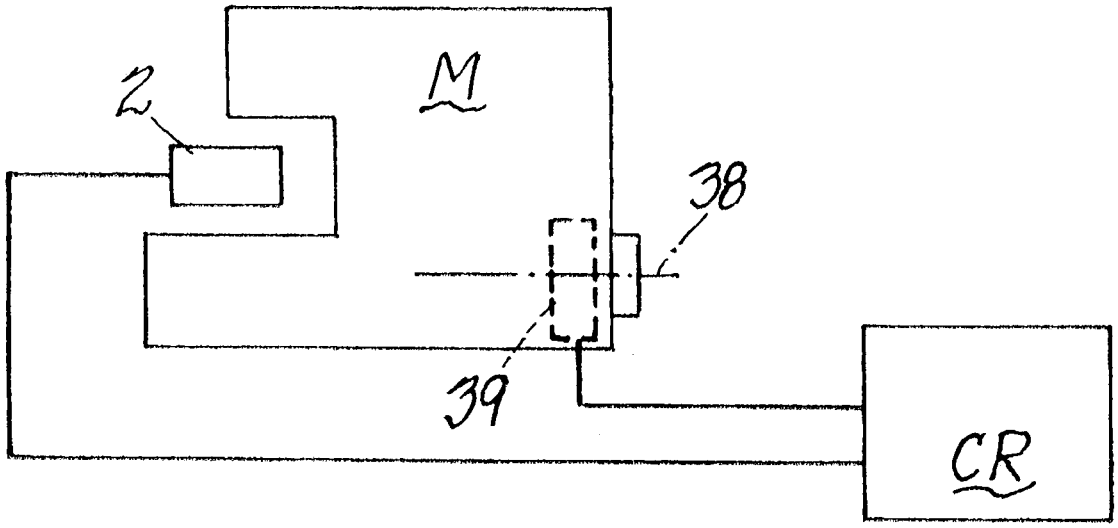
FIG. 6 is a schematic view showing a modified example of the same.

FIG. 1 is a partial cutaway plan view showing the principal portion of the driving process of the embodiment, and the usage during the upper decorative stitch operation. FIG. 2 is a side view of the same, FIG. 3 is a partial cutaway plan view showing the usage when the embodiment is switched to the smock stitch operation, FIG. 4 is a side view of the same, and FIGS. 5 and 6 are schematic views showing construction to drive the stepping motor in synchronism with the elevating motion of a needle bar.

In FIGS. 1 and 2, reference numeral 1 designates a movable frame provided at the back side of a presser foot (not shown) so that a stepping motor 2 can be mounted on the lateral surface of the frame which has an L-shaped cross section, and so that a support shaft 3 can be erected on the plane surface of the movable frame. Levers (4*a* and 4*b*) are swingably fitted at two upper and lower stages of the movable frame onto the support shaft 3. An upper decorative stitching spreader 5 is mounted on the fore end (at the right side of drawing) of the upper lever 4*a*. Sector gears (6*a* and 6*b*) are integrated with the rear ends (the left side of drawing) of the lever 4. A driving gear 7 is engageable with an output shaft 8 of stepping motor 2 through a bevel gear transmission mechanism 9 and with the upper sector gear 6*a* so as to drive the upper lever 4*a* and spreader 5 in reciprocation along the upper surface of the presser foot. A driven gear 10 is engageable with the driving gear 7 and lower sector gear 6*b* so as to drive the lower lever 4*b* in reciprocation and in the mutually reverse (opposite) direction in an equal swing width with respect to the upper lever 4*a*.

In the usage of upper decorative stitch operation shown in FIG. 1, this embodiment is so constructed that the spreader 5 is mounted on the upper lever 4*a* only. A counter bar 12 is connected through a connecting member 13 to the tip of a rod 11 fixed to the base of lower lever 4*b*. The counter bar 12 is slidably fitted at the middle portion thereof into a slide guide part 14 provided at one end (the right side of drawing) of movable frame 1 in the cloth feed direction. A thread guide 16 positioned at the right side of the needle position 15 and mounted to the tip of counter bar 12 is longitudinally (leftward and rightward in drawing) reciprocated. The thread guide 16 reciprocates the forward movement when the spreader 5 approaches so as to allow the retreating moving spreader 5 to pull out an upper decorative stitch thread.

The thread guide 16 simultaneously moves forward from the largest retreat position corresponding to the reversal of upper decorative stitching spreader 5 from the left to the right, and puts the upper decorative stitch thread onto a hook 5' at the tip of spreader 5 going around to the rear surface of thread guide 16 as shown in FIG. 2. Therefore, while retreating and pulling out the stitch thread by the resorting spreader and then retreating, the thread guide 16 gets higher under one or two needles at the points thereof among the needles (not shown), and puts the upper decorative stitch thread from this side onto a left side needle lower in the needle point, and then returns.

Also, the thread guide 16, when the second needle drops, moves forwardly while looping the upper decorative stitch thread onto the rightmost needle. In the largest forward moving position, the upper decorative stitch thread is reciprocated to be put onto the hook 5' of spreader 5 as mentioned above, so that the reciprocation performs the upper decorative and flat stitch work.

Next, explanation will be given of a case of shifting the embodiment into state in which the smock stitch operation is used as shown in FIG. 3.

The movable frame 1 on which is mounted the stepping motor 2, support shaft 3, and levers 4*a* and 4*b*, as shown in FIG. 2, has on the upper surface a fixed frame 17 having an L-shaped cross section, so that a shifting means 18 provided between both the frames is operated to enable the embodiment to be shifted to a state for performance of smock stitch operation.

The shifting means 18 for shifting the movable frame 1 to the position corresponding to the stitch operation with respect to the fixed frame 17 mounted on the sewing machine side is considered to have various modes. In this embodiment, the shifting means 18, as shown, comprises fixed pins 19 disposed at three positions on the movable frame 1; slots 20 equal in number to the fixed pins 19 and perforating the fixed frame 17 so as to guide the pins 19 parallel to the needle position; a presser plate which is put on the fixed frame 17 so as to bring the movable frame 1 in close contact with the rear surface of fixed frame 17 and in slidably press contact therewith by using stoppers 21 retained on the upper ends of fixed pins 19, respectively; a switching lever 26, which is pivotally supported to a fulcrum shaft 23 erected on the movable frame 1 and has a slot 24 provided at the middle portion of lever 26 in which a support pin 25 erected on the movable frame 1 is fit; and a toggle spring 27 stretched between the tip 26' of switching lever 26 and one end of movable frame 1 so as to keep the movable frame 1 in the upper decorative stitch position and smock stitch position.

Prior to the switching operation and after the upper decorative stitching spreader 5, counter lever 12, and thread guide 16 are removed from the upper lever 4*a*, and when the switching lever 26 positioned at the upper portion of FIG. 1 is switched in the direction of the arrow of the phantom line in the drawing, the movable frame 1 is guided by the respective fixed pins 19 and slots 20 so as to move along the rear surface of fixed frame 17 together with the loaded stepping motor 2, support shaft 3 and levers 4*a* and 4*b* and parallel to the needle position 15. Therefore, the support shaft 3 shifts from the point P1 shown in FIG. 1 to the point P3 shown in FIG. 3.

The movable frame 1, after being shifted, is strictly held at the predetermined position in the moving destination by a pull of toggle spring 27 and close contact with the stoppers 21. The amount of movement in this direction in this embodiment is 10 mm. The support shaft 3 shifted to the point P2, as shown in FIG. 3, just faces the center line S of needle position 15.

As mentioned above, the smock stitching spreaders 5*a* and 5*b* (instead of the upper decorative stitching spreader 5)

are fitted into an insertion bore 28 at the fore end of upper and lower levers 4*a* and 4*b* which shift the support shaft 3 to the point P2, thereby arranging the preparation for smock stitch operation.

The upper and lower levers 4*a* and 4*b,* which respectively set the center of swinging motion thereof on the shifted support shaft 3, alternately swing in the reverse directions as in the above-mentioned upper decorative stitch operation.

In addition, the detailed description of smock stitch operation is omitted because it conforms to the conventional well-known stitch operation.

In addition, in the drawings, reference numeral 29 designates an arcuate detection plate extending from the lower lever 4*b,* and reference number 30 designates a sensor engageable with the detection plate so as to restore the levers 4*a* and 4*b* to the zero points. In addition, reference number 31 designates a substrate for the sensor 30 and is mounted at the side of the movable lever, and reference number 32 designates a threaded bore for mounting therethrough the fixed frame 17 onto the lateral side of the sewing machine.

Next, an explanation will be given of a method for driving the stepping motor 2 in synchronism with the elevating motion of a needle bar.

The method of synchronizing the elevating motion of the needle bar with the operation of the stepping motor is variously considered, and an example thereof will be explained with reference to FIGS. 5 and 6.

In the example shown in FIG. 5, a dog 34 is mounted onto a needle clamp 33, photo sensors 36*a* and 36*b* are mounted on a presser foot 35 so as to detect the vertical position of the needle 37 for every stitch, and signals from the photo sensors 36*a* and 36*b* are transmitted to a controller CR. Thus, the stepping motor 2 is driven through a motor drive MD connected to the controller CR.

In the example shown in FIG. 6, an encoder 39 is mounted to a main spindle 38 of sewing machine M and the controller CR is connected to the encoder 39, so that the operational timing of stepping motor 2 is indicated from the rotational position (number of rotations) of main spindle 38.

Hereinafter, the control and operation of controller CR will be summarized.

When a power switch provided at the controller CR is turned on, the stepping motor 2 laterally rotates according to the predetermined program, and the detection plate 29 engages with the sensor 30, so that the hook 5' of spreader 5 and thread guide 16 face each other at the zero point during the upper decorative stitch operation. Also, during smock stitch operation, the spreaders 5*a* and 5*b,* as shown in FIG. 3, match at the zero point so as to allow thread passing bores 41 at the tips of the spreaders 5*a* and 5*b* to just face the needle position 15.

Next, when the sewing machine rotates, on the basis of signals from the photo sensors 36*a* and 36*b* engageable with the dog 34 mounted on the needle clamp 33 (in a case of FIG. 5), or a signal from the encoder 39 detecting the rotation of main spindle 38 (in a case of FIG. 6), the spreader 5, or 5*a* and 5*b* moves in reciprocation within the amplitude predetermined by the program, so as to perform the selected upper decorative stitch or the smock stitch operation. In addition, it is not different from the conventional stitch operation to change the number of upper decorative stitch threads and that of the needle for hooking the thread.

EFFECT OF THE INVENTION

The spreader driving device of the present invention, which is constructed and used as mentioned above, can use one sewing machine to perform two modes of smock stitching and upper decorative stitching. Also, it is easy to switch modes, and the center of the swinging motion of the spreader can be shifted to a suitable position for the selected stitch mode, thereby having many superior effects.

What is claimed is:

1. A spreader driving device of a sewing machine, comprising:

a frame to be mounted on a back side of a presser foot of the sewing machine;

a stepping motor having an output shaft and a drive gear on said output shaft to be driven by said stepping motor, said stepping motor being mounted on said frame;

a support shaft mounted on said frame; and a lever having a sector gear on a rear end thereof, and having a spreader at a fore end thereof, said lever being pivotally mounted on said support shaft and being arranged such that said sector gear engages said drive gear;

wherein said stepping motor is operable to rotate said output shaft in synchronism with an elevating motion of a needle bar so as to swing said lever about said support shaft such that said spreader reciprocates along an upper surface of the presser foot.

2. The spreader driving device of claim 1, wherein said frame comprises a movable frame portion and a fixed frame portion to be mounted to the presser foot, wherein said stepping motor, said support shaft, and said lever are mounted to said movable frame;

further comprising a shifting device between said movable frame portion and said fixed frame portion, said shifting device being operable to move said movable frame portion parallel to a needle position of the sewing machine and relative to said fixed frame portion, and to hold said movable frame portion at a shift location such that a center of a reciprocating motion of said spreader shifts corresponding to a stitch operation.

3. The spreader driving device of claim 2, wherein said lever comprises a first lever and said drive gear comprises a first drive gear engaged with said sector gear of said first lever, further comprising a second drive gear engaged with said first drive gear so as to rotate in a direction opposite to a direction of rotation of said first drive gear, and further comprising a second lever having a sector gear on a rear end thereof, said sector gear of said second lever engaging said second drive gear, said second lever being pivotally mounted on said support shaft such that said stepping motor is operable to rotate said output shaft so as to swing said first lever and said second lever in opposite directions about said support shaft, each of said first lever and said second lever having a fore end and having one of an upper decorative stitching spreader and a smock stitching spreader exchangeably mounted on said fore end, said shifting device being operable to shift said movable frame portion so as to move said support shaft to a right position such that said upper decorative stitching spreader is swung during an upper decorative stitch operation, and so as to move said support shaft to a center position such that said smock stitching spreader is swung during a smock stitch operation.

4. The spreader driving device of claim 3, wherein said shifting device comprises:

a plurality of slots formed in said fixed frame portion;

a plurality of fixed pins on said movable frame portion and arranged so as to be fitted into said slots of said fixed frame portion such that said fixed pins are guided in a direction parallel to a needle position of said sewing machine by said slots;

a snap ring attached to an upper surface of each of said fixed pins extending through said slots;

a plurality of presser plates operable to bring said movable frame portion into slidable contact with a rear surface of said fixed frame portion via said snap ring on each of said fixed pins;

a switching lever pivotally supported by said fixed frame on a fulcrum shaft, said switching lever having a slot;

a support pin on said movable frame portion and fitted into said slot of said switching lever; and a toggle spring extending between a fore end of said switching lever and an end of said moveable frame portion so as to hold said movable frame portion in an upper decorative stitch position and a smocking stitch position.

5. The spreader driving device of claim 3, further comprising:

a rod fixed to a base of said first lever;

a counter bar detachably connected to a fore end of said rod;

a slide guide part on said movable frame portion and arranged along a cloth feed direction, said counter bar being slidably fitted onto said slide guide part; and a thread guide mounted onto a tip of said counter bar so that said thread guide is synchronized with the movement of said first lever during the decorative stitch operation so as to be slid in a longitudinal direction at a lateral side of the needle position.

* * * * *